US007441547B2

(12) United States Patent
Kawamura et al.

(10) Patent No.: US 7,441,547 B2
(45) Date of Patent: Oct. 28, 2008

(54) METHOD OF FEEDING FUEL TO AN ENGINE, FUEL FEED AMOUNT CONTROL SYSTEM OF AN ENGINE, AND MOTORCYCLE COMPRISING FUEL FEED AMOUNT CONTROL SYSTEM

(75) Inventors: Naoki Kawamura, Takasago (JP); Satoru Watabe, Akashi (JP)

(73) Assignee: Kawasaki Jukogyo Kabushiki Kaisha, Kobe-shi (JP)

( * ) Notice: Subject to any disclaimer, the term of this patent is extended or adjusted under 35 U.S.C. 154(b) by 0 days.

(21) Appl. No.: 11/522,110

(22) Filed: Sep. 15, 2006

(65) Prior Publication Data

US 2007/0062491 A1 Mar. 22, 2007

(30) Foreign Application Priority Data

Sep. 15, 2005 (JP) ..... 2005-268099

(51) Int. Cl.
*F02D 41/12* (2006.01)

(52) U.S. Cl. ..... 123/493; 123/325; 701/110

(58) Field of Classification Search ..... 123/320–329, 123/493; 701/110
See application file for complete search history.

(56) References Cited

U.S. PATENT DOCUMENTS

| | | | | |
|---|---|---|---|---|
| 5,492,102 | A * | 2/1996 | Thomas et al. | 123/493 |
| 6,085,717 | A * | 7/2000 | Kamura et al. | 123/325 |
| 6,321,722 | B1 * | 11/2001 | Nakano | 123/493 |
| 6,526,946 | B1 * | 3/2003 | Kanno | 123/493 |
| 6,830,038 | B2 * | 12/2004 | Yamashita et al. | 123/493 |

FOREIGN PATENT DOCUMENTS

JP 10-184423 7/1998

* cited by examiner

*Primary Examiner*—Erick Solis
(74) *Attorney, Agent, or Firm*—Alleman Hall McCoy Russell & Tuttle LLP

(57) ABSTRACT

A method of feeding fuel to an engine, comprising the steps of determining whether or not the engine is decelerating based on a time-lapse change rate of an engine speed of the engine, and reducing an amount of the fuel to be fed to air taken into the engine from outside to less than a reference amount preset according to the engine speed when it is determined that the engine is decelerating.

5 Claims, 9 Drawing Sheets

METHOD OF FEEDING FUEL TO AN ENGINE, FUEL FEED AMOUNT CONTROL SYSTEM OF AN ENGINE, AND MOTORCYCLE COMPRISING FUEL FEED AMOUNT CONTROL SYSTEM

TECHNICAL FIELD

The present invention relates to a method of feeding fuel to an engine and a fuel feed amount control system of an engine. More particularly, the present invention relates to a method and system for reducing a fuel feed amount during deceleration of engine speed of the engine, and a motorcycle comprising the fuel feed amount control system.

BACKGROUND ART

In general, a reference value of the amount of fuel fed to an engine with respect to the amount of air taken into the engine is determined based on an engine speed, a throttle opening degree, an air-intake pressure, etc. The reference value indicates a suitable amount of fuel set for a constant speed running of the engine. A controller is configured to control an operation of the engine and to determine the fuel feed amount set as the reference value based on the engine speed, the throttle opening degree, etc. received from sensors. An injector feeds the determined amount of fuel to air in the engine. However, during a deceleration state of the engine, the amount of fuel to be combusted correctly tends to be less than the reference value. For this reason, the controller determines whether or not the engine is decelerating based on the engine speed and the throttle opening degree and executes a control (fuel amount reduction control) to reduce the fuel feed amount to less than the reference value if it is determined that the engine is decelerating (e.g., Japanese Laid-Open Patent Application Publication No. Hei. 10-184423).

A specific control method will now be described. In a graph with an engine speed (N) on a horizontal axis and a throttle opening degree (Th) on a vertical axis, the relationship between the throttle opening degree and the engine speed under a steady state, corresponding to a predetermined gear position, are represented by a line (reference curve) that rises to the right. The graph indicates that the engine is decelerating when the throttle opening degree corresponding to the engine speed at a moment is below the reference curve and the engine is accelerating when the throttle opening degree is above the reference curve.

It is necessary to determine whether or not the engine is decelerating while considering an error contained in a value of the throttle opening degree, etc., detected by a sensor. Typically, a threshold curve is set below the reference curve so as to conform to the reference curve. When the detected throttle opening degree is below the threshold curve, the controller determines that the engine is decelerating, and executes the fuel amount reduction control to reduce the fuel feed amount to less than the reference value.

With respect to the relationship between an air-intake pressure and the engine speed under the steady state, a reference curve, and a threshold curve are set in the same manner as described above. A controller compares a detected value of the air-intake pressure corresponding to a detected value of the engine speed from sensors to the threshold curve to determine whether or not the engine is decelerating and executes the fuel amount reduction control.

It is difficult to determine whether or not the engine is decelerating in a low engine speed range based on the throttle opening degree and the engine speed. This is because the reference curve and the threshold curve set as described above are present in close proximity to each other in a vertical direction in the low engine speed range so that the controller cannot in some cases correctly determine whether or not the engine is decelerating unless the throttle opening degree is detected precisely.

Even in medium and high engine speed ranges, it is in some cases difficult to correctly determine whether or not the engine is decelerating, based on the throttle opening degree and the engine speed of the engine. For example, when an operator performs a quick throttle operation to decrease the throttle opening degree during, for example, an accelerating state of the engine, it takes some time for the engine to transition from the acceleration state to the deceleration state through a constant speed state. As a result, the controller may determine that the engine is decelerating based on the relationship between the throttle opening degree and the engine speed, although the engine is still accelerating. On the other hand, when the operator performs a quick throttle operation to increase the throttle opening degree during a deceleration state of the engine, the controller may determine that the engine is accelerating although the engine is still decelerating.

The same problems arise in various engines irrespective of the type of engine which varies in the number of cylinders, arrangement of the cylinders, etc., and the type of mobile objects such as motorcycles. In addition, the same problems arise when it is determined whether or not the engine is decelerating based on the air-intake pressure and the engine speed.

SUMMARY OF THE INVENTION

The present invention addresses the above described problems, and an object of the present invention is to provide a method of feeding fuel to an engine and a fuel feed amount control system of an engine, which are capable of feeding a suitable amount of fuel to air taken into the engine from outside, and a motorcycle comprising the fuel feed amount control system.

According to one aspect of the present invention, there is provided a method of feeding fuel to an engine, comprising the steps of determining whether or not the engine is decelerating based on a time-lapse change rate of an engine speed of the engine; and reducing an amount of fuel to be fed to air taken into the engine from outside to less than a reference amount preset according to the engine speed when it is determined that the engine is decelerating.

According to such a method, since it is determined whether or not the engine is decelerating based on the time-lapse change rate of the engine speed, correct deceleration determination can be achieved. Therefore, even in a low engine speed range of the engine or even when the operator performs abrupt throttle operation, it can be determined whether or not the engine is decelerating and a suitable amount of fuel can be supplied to the air taken into the engine. As a result, fuel amount reduction control can be correctly executed under a deceleration state of the engine over a wider engine speed range.

According to another aspect of the present invention, there is provided a fuel feed amount control system of an engine, comprising an engine speed sensor configured to detect an engine speed of the engine; a fuel feeder configured to feed fuel to air taken into the engine from outside; and a controller configured to cause the fuel feeder to feed a predetermined amount of fuel to air, based on a signal received from the engine speed sensor; wherein the controller is configured to obtain a time-lapse change rate of the engine speed based on a signal received from the engine speed sensor; determine whether or not the engine is decelerating based on the time-lapse change rate; and cause the fuel feeder to reduce a fuel feed amount to less than a reference amount preset according to the engine speed when it is determined that the engine is decelerating.

In such a configuration, the controller is able to determine whether or not the engine is decelerating correctly and to cause the fuel feeder to reduce the fuel feed amount under the deceleration state of the engine over the wider engine speed range, as in the above method.

The fuel feed amount control system may further comprise at least one of a throttle opening degree sensor configured to detect an opening degree of a throttle valve and an air-intake pressure sensor configured to detect pressure of the air taken into the engine. The controller may be configured to determine whether or not the engine is decelerating, based on the time-lapse change rate of the engine speed, the engine speed, and the throttle opening degree obtained from a signal received from the throttle opening degree sensor or the air-intake pressure obtained from a signal received from the air-intake pressure sensor. In such a configuration, since it is determined whether or not the engine is decelerating based on the engine speed and the throttle opening degree or the air-intake pressure that have been conventionally used to determine deceleration, in addition to the time-lapse change rate of the engine, deceleration determination can be executed correctly over a wider engine speed range.

The fuel feed amount control system may further comprise a gear position sensor configured to detect a gear position of a transmission system of the engine. The controller may be configured to determine whether or not the engine is decelerating, based on the time-lapse change rate of the engine speed, the engine speed, the throttle opening degree or the air-intake pressure, and the gear position obtained from a signal received from the gear position sensor. In such a configuration, deceleration determination suitable for each gear position can be executed. Since a reference curve and a threshold curve that indicate the relationship between the engine speed and the throttle opening degree or the air-intake pressure varies a little for each gear position, determination precision can be improved by determining whether or not the engine is decelerating, based on the threshold curve considering the gear position.

The fuel feed amount control system may further comprise a clutch sensor configured to detect an on-state or an off-state of a clutch. The controller may be configured to determine whether or not the engine is decelerating, based on the time-lapse change rate of the engine speed, the engine speed, the throttle opening degree or the air-intake pressure, the gear position, and the on-state or the off-state of the clutch obtained from a signal received from the clutch sensor.

The controller may cause the fuel feeder to reduce the fuel feed amount to less than the reference amount preset according to the engine speed when it is determined that the clutch is in the on-state, based on the signal received from the clutch sensor.

According to a further aspect of the present invention, there is provided a motorcycle comprising a fuel feed amount control system of an engine including an engine speed sensor configured to detect an engine speed of the engine; a fuel feeder configured to feed fuel to air taken into the engine from outside; and a controller configured to cause the fuel feeder to feed a predetermined amount of the fuel to the air, based on a signal received from the engine speed sensor; wherein the controller is configured to obtain a time-lapse change rate of the engine speed based on the signal received from the engine speed sensor; determine whether or not the engine is decelerating based on the time-lapse change rate; and cause the fuel feeder to reduce a fuel feed amount to less than a reference amount preset according to the engine speed when it is determined that the engine is decelerating.

In such a configuration, it is possible to provide a motorcycle that is able to determine whether or not the engine is decelerating correctly and to execute fuel amount reduction under the deceleration state of the engine over the wider engine speed range. As a result, the motorcycle is able to improve fuel efficiency.

The above and further objects and features of the invention will more fully be apparent from the following detailed description with accompanying drawings.

DETAILED DESCRIPTION OF THE PREFERRED EMBODIMENTS

Now, an embodiment of a method of feeding fuel to an engine, a fuel feed amount control system, and a motorcycle comprising the fuel feed amount control system according to the present invention will be described with reference to the accompanying drawings. As used herein, the term "forward" refers to the direction in which the motorcycle is running, and other directions means directions seen from the perspective of a rider mounting the motorcycle, except for a case specifically illustrated. In addition, the terms "downstream" and "upstream" are defined in a flow direction of air that is taken into the engine from outside.

Figure 1:
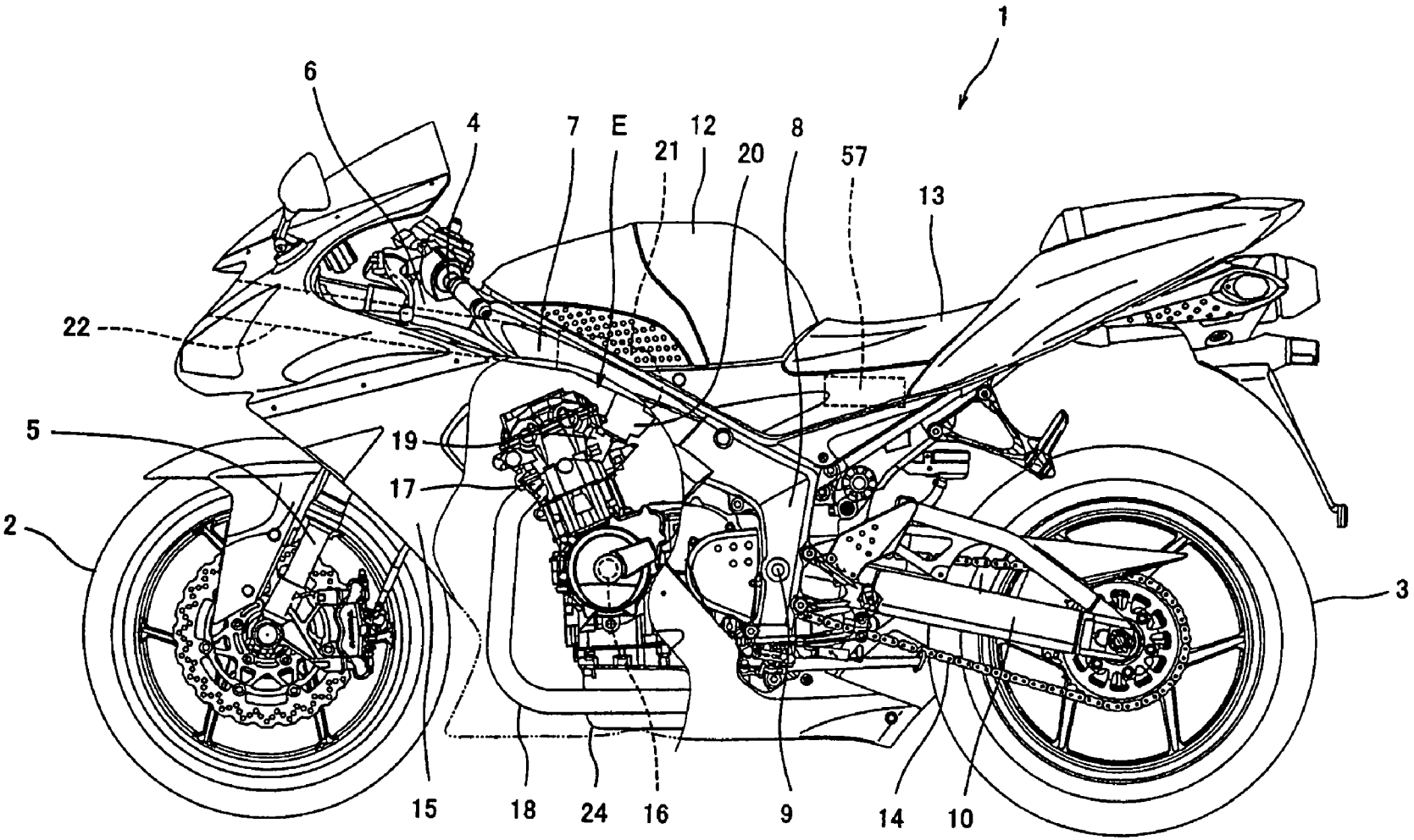
FIG. 1 is a left side view of a motorcycle according to an embodiment of the present invention.

FIG. 1 is a left side view of a motorcycle 1 according to an embodiment of the present invention. Turning to FIG. 1, the motorcycle 1 of a road sport type includes a front wheel 2 and a rear wheel 3. The front wheel 2 is rotatably mounted to a lower portion of a front fork 5 extending substantially vertically. A bar-type steering handle 4 extending in a lateral direction of a vehicle body is attached to an upper portion of the front fork 5 by a steering shaft (not shown). The steering shaft is rotatably mounted to a head pipe 6 forming a part of a frame of the motorcycle 1. The front wheel 2 is steered by the rider's operation of rotating the steering handle 4 to the right or to the left.

The frame of the motorcycle 1 is of a twin tube type. A pair of right and left main frames 7 (only left main frame 7 is illustrated in FIG. 1) extends rearward from the head pipe 6. A pivot frame (swing arm bracket) 8 extends downward from a rear portion of each main frame 7. A swing arm 10 is mounted at a front end portion thereof to the pivot frame 8 so as to be pivotable around a pivot 9 attached on the pivot frame 8. The rear wheel 3 is rotatably mounted to a rear end portion of the swing arm 10.

A fuel tank 12 is disposed above the main frame 7 and behind the steering handle 4, and a seat 13 is mounted behind the fuel tank 12 and is configured to be straddled by the rider. An engine E is mounted below a region between the right and left frames 7. A cowling 15 is mounted to cover side regions of the engine E and a forward region of the steering shaft. The engine E is an in-line four-cylinder four-cycle engine. The engine E is mounted in such a manner that a center axis of a crankshaft 16 extends in the lateral direction of the vehicle body. A drive force is transmitted from the engine E, through a chain 14, to the rear wheel 3, which rotates, thus generating power to move the motorcycle 1.

An exhaust pipe 18 is coupled to exhaust ports 17 of the engine E. The exhaust pipe 18 extends from a forward region of the engine E, through a region thereunder, to a rearward region. A downstream end portion of a throttle device 20 is coupled to intake ports 19 of the engine E. An air cleaner box 21 is disposed between the right and left main frames 7 and is coupled to an upstream end portion of the throttle device 20. An air-intake duct 22 extends forward from the air cleaner box 21. An upstream end portion of the air-intake duct 22 opens at a front portion of the cowling 15. The engine E is configured to take in air from outside by utilizing a wind pressure (ram-pressure).

Figure 2:
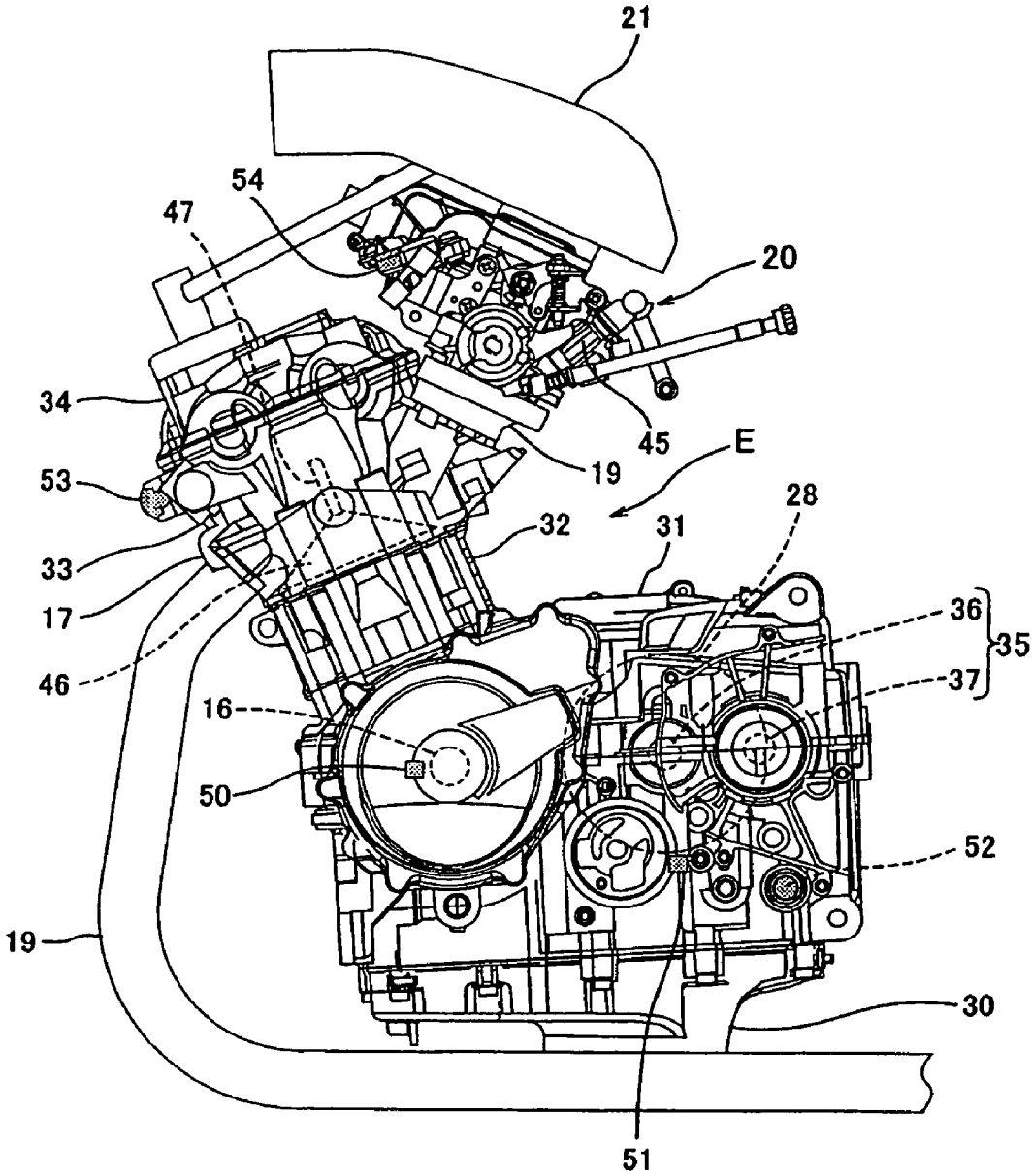
FIG. 2 is a left side view of an engine mounted in the motorcycle of FIG. 1.

FIG. 2 is a left side view showing the engine E of the motorcycle 1 of FIG. 1. The engine E is constructed in such a manner that an oil pan 30, a crankcase 31, a cylinder block 32, a cylinder head 33, and a cylinder head cover 34 are disposed in this order from below. In an interior of the crankcase 31, the crankshaft 16, and a main shaft 36 and a countershaft 37 constituting a transmission system 35 are accommodated. A clutch 28 is mounted on one end of the main shaft 36. Under a clutch-on state, the clutch 28 is configured to transmit rotation of the crankshaft 16 to the main shaft 36.

A DOHC (double overhead camshaft) valve system (not shown) is accommodated in an interior of the cylinder head cover 34. The exhaust ports 17 are formed at a front region of the cylinder head 33, and the intake ports 19 are formed at a rear region of the cylinder head 33. The throttle device 20 is coupled to the intake ports 19 as described above.

Figure 3:
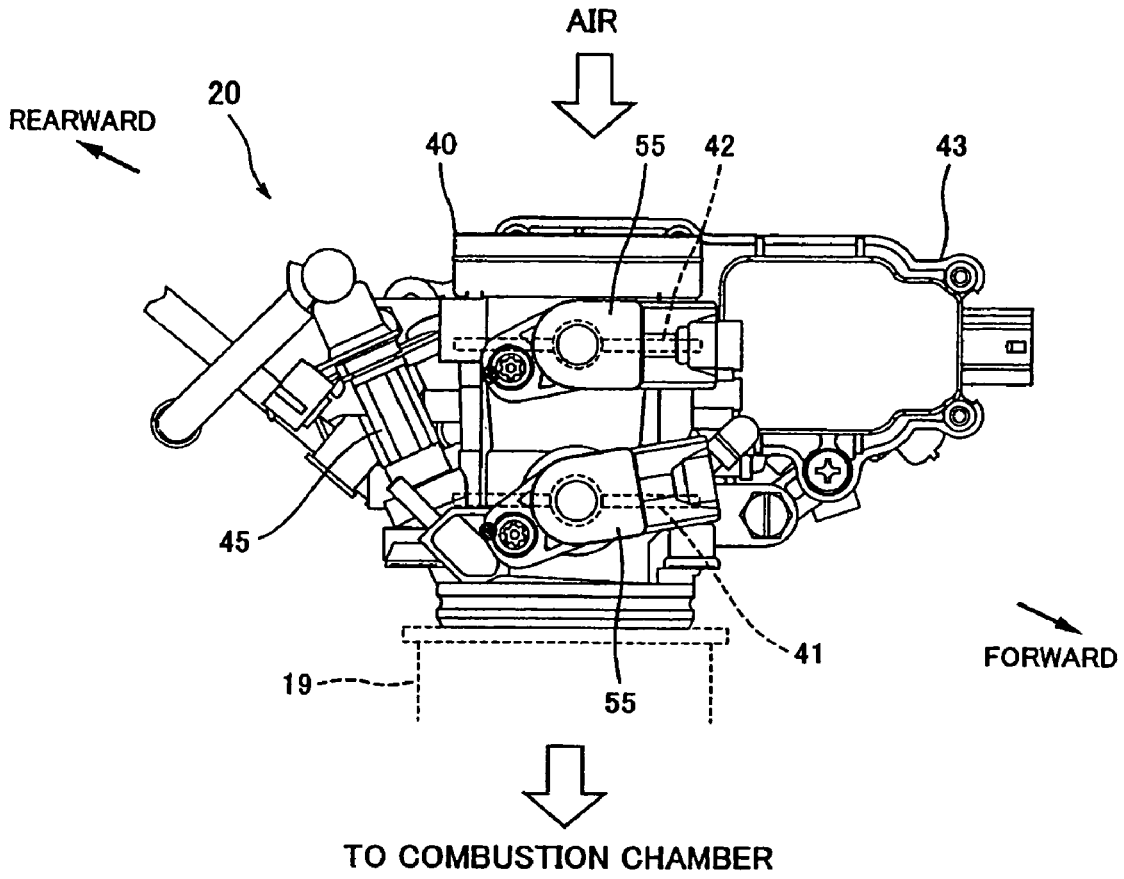
FIG. 3 is a right side view of a throttle device equipped in the engine of FIG. 2.

As shown in FIG. 3, the throttle device 20 includes a throttle body portion 40 having four air-intake passages respectively corresponding to the four intake ports 19 of the engine E. A main throttle valve 41 located downstream and a sub-throttle valve 42 located upstream are mounted in each air-intake passage of the throttle body portion 40. The main throttle valve 41 is coupled to a throttle grip (not shown) mounted to a right grip portion of the steering handle 4 (see FIG. 1) through a cable, and is configured to rotate according to the rider's operation of rotating the throttle grip to open and close the air-intake passage. An actuator 43 such as a motor is coupled to a rotational shaft of the sub-throttle valve 42 via a transmission gear. The sub-throttle valve 42 is configured to rotate based on an instruction from an ECU (electric control unit) 57 which is a controller disposed below the seat 13 as shown in FIG. 1 to open and close the air-intake passage.

As shown in FIGS. 2 and 3, the throttle device 20 includes a fuel injector (hereinafter simply referred to as an injector) 45 mounted to a rear region of the throttle body portion 40. The injector 45 is mounted in each air-intake passage. Fuel is fed from the fuel tank 12 (see FIG. 1) disposed thereabove to the injector 45 through a pipe (not shown). The injector 45 is configured to inject fuel in a mist into an interior of the air-intake passage based on an instruction from the ECU 57 (see FIG. 1). The injected fuel is mixed into the air and the resulting air-fuel mixture is suctioned into a combustion chamber 46 (see FIG. 2) defined by an inner wall of the cylinder block 32 and an inner wall of the cylinder head 33. An ignition device 47 is attached to an upper region of the combustion chamber 46. The ignition device 47 is configured to ignite based on an instruction from the ECU 57 to combust the fuel-air mixture in an interior of the combustion chamber 46.

As shown in FIG. 2, various sensors are attached on the engine E. A crank angle sensor 50 that detects a rotational angle of the crankshaft 16, and a clutch sensor 51 that detects an on-state or an off-state of the clutch 28 are attached on the crankcase 31. A gear position sensor 52 is attached on a rear portion of the crankcase 31 and is configured to detect a gear position decided by the transmission system 35 including the main shaft 36 and the countershaft 37.

A cam phase (angle) sensor 53 is attached on a front region of the cylinder head 33 and is configured to detect a phase of a cam (not shown) that is included in the DOHC valve system and is mounted in each cylinder. An air-intake pressure sensor 54 and a throttle opening degree sensor 55 (FIG. 3) are attached on the throttle device 20. The air-intake pressure sensor 54 is configured to detect an average pressure in the interior of each air-intake passage. The throttle opening degree sensor 55 (see FIG. 3) is configured to detect an opening degree of each of the main throttle valve 41 and the sub-throttle valve 42. The sensors 50 to 55 are communicatively coupled to the ECU 57 (see FIG. 1) and are configured to output detection signals to the ECU 57. Based on these detection signals, the ECU 57 controls the amount of the fuel fed to the air in the engine E (fuel amount reduction control).

Figure 4:
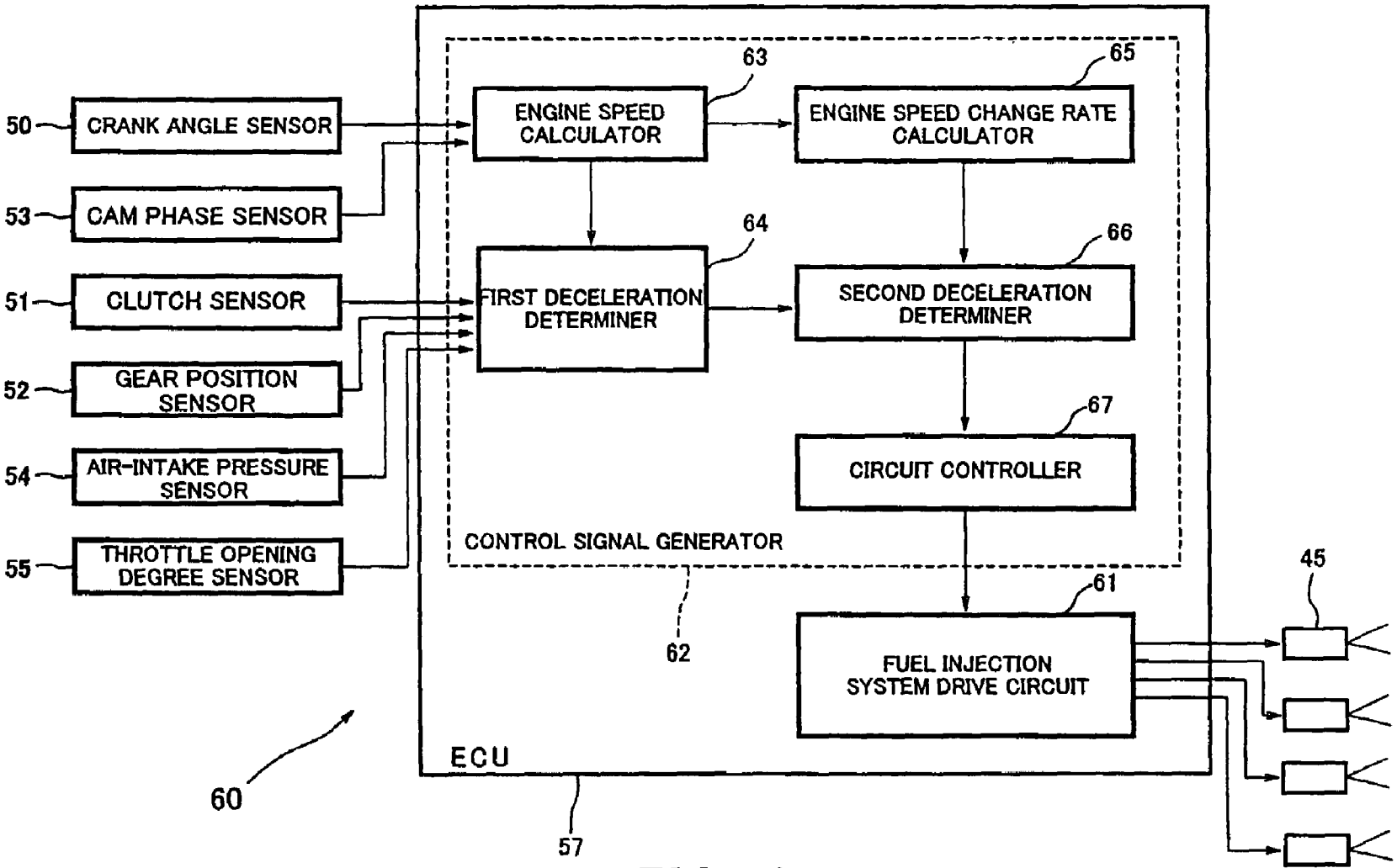
FIG. 4 is a block diagram showing a configuration of a fuel feed amount control system configured to control an amount of fuel fed to the engine under a deceleration state.

FIG. 4 is a block diagram showing a configuration of the fuel feed amount control system 60 to execute the fuel amount reduction control with respect to the engine E under the deceleration state. As shown in FIG. 4, the fuel feed amount control system 60 includes the sensors 50 to 55, the ECU 57, the injector 45, etc. The ECU 57 includes a fuel injection system drive circuit 61 configured to drive the injector 45 mounted in each cylinder, and a control signal generator 62 including a MPU (micro processing unit) configured to output a control signal to the fuel injection system drive circuit 61. The control signal generator 62 includes an engine speed calculator 63 configured to calculate the engine speed of the engine E based on either one or both of signals from the crank angle sensor 50 and the cam phase sensor 53, and a first deceleration determiner 64 configured to receive detection signals from the clutch sensor 51, the gear position sensor 52, the air-intake pressure sensor 54, and the throttle opening degree sensor 55, and a signal from the engine speed calculator 63 and to execute a temporal deceleration determination process with respect to the engine E. The engine speed calculator 63 is configured to receive the signal(s) from the crank angle sensor 50 and/or the cam phase sensor 53 with a predetermined sampling period and to calculate the engine speed by dividing a value indicated by the received signal by the sampling period.

The control signal generator 62 of the ECU 57 further includes an engine speed change rate calculator 65 configured to calculate a change rate (time-lapse change rate) of the engine speed of the engine E based on the signal from the engine speed calculator 63, a second deceleration determiner 66 configured to execute a final deceleration determination process in order to determine whether or not to reduce a fuel feed amount based on signals received from the engine speed change rate calculator 65 and the first deceleration determiner 64, and a circuit controller 67 configured to generate a control signal for controlling an operation of the fuel injection system drive circuit 61 based on a determination result from the second deceleration determiner 66 and to output the control signal to the fuel injection system drive circuit 61. The engine speed change rate calculator 65 calculates the time-lapse change rate of the engine speed by dividing the value of the engine speed indicated by the signal received with a predetermined period from the engine speed calculator 63 by the period. A positive value of the change rate indicates that the engine E is accelerating and a negative value of the change rate indicates that the engine E is decelerating.

The fuel feed amount control system 60 configured as described above executes the temporal deceleration determination process (first deceleration determination process) based on the engine speed of the engine E and the throttle opening degree or the air-intake pressure, and then executes a final deceleration determination process (second deceleration determination process) based on the engine speed change rate of the engine E. Based on the determination results, the fuel feed amount control system 60 executes the fuel amount reduction control. This will be described in detail.

Figure 5:
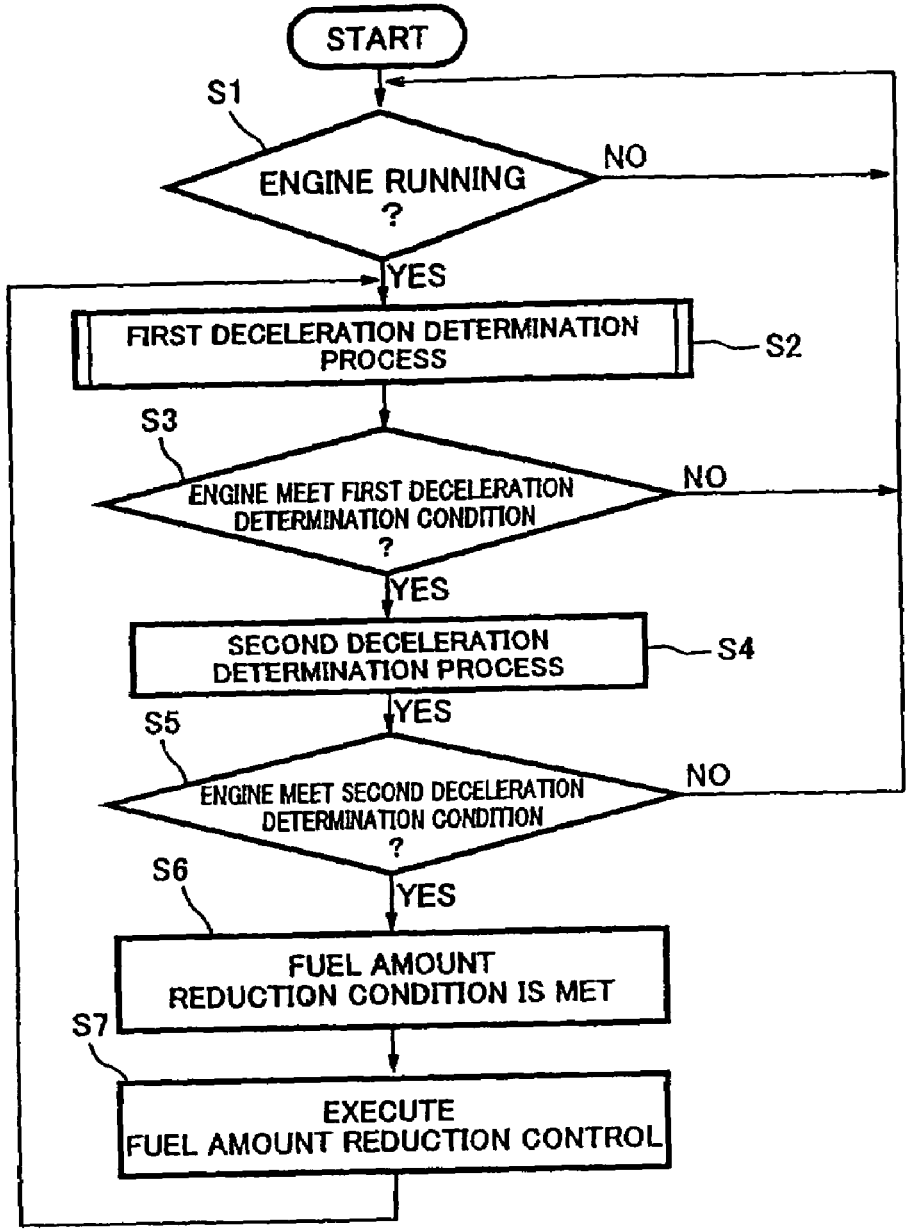
FIG. 5 is a flowchart showing an operation of the fuel feed amount control system of FIG. 4.
Figure 6:
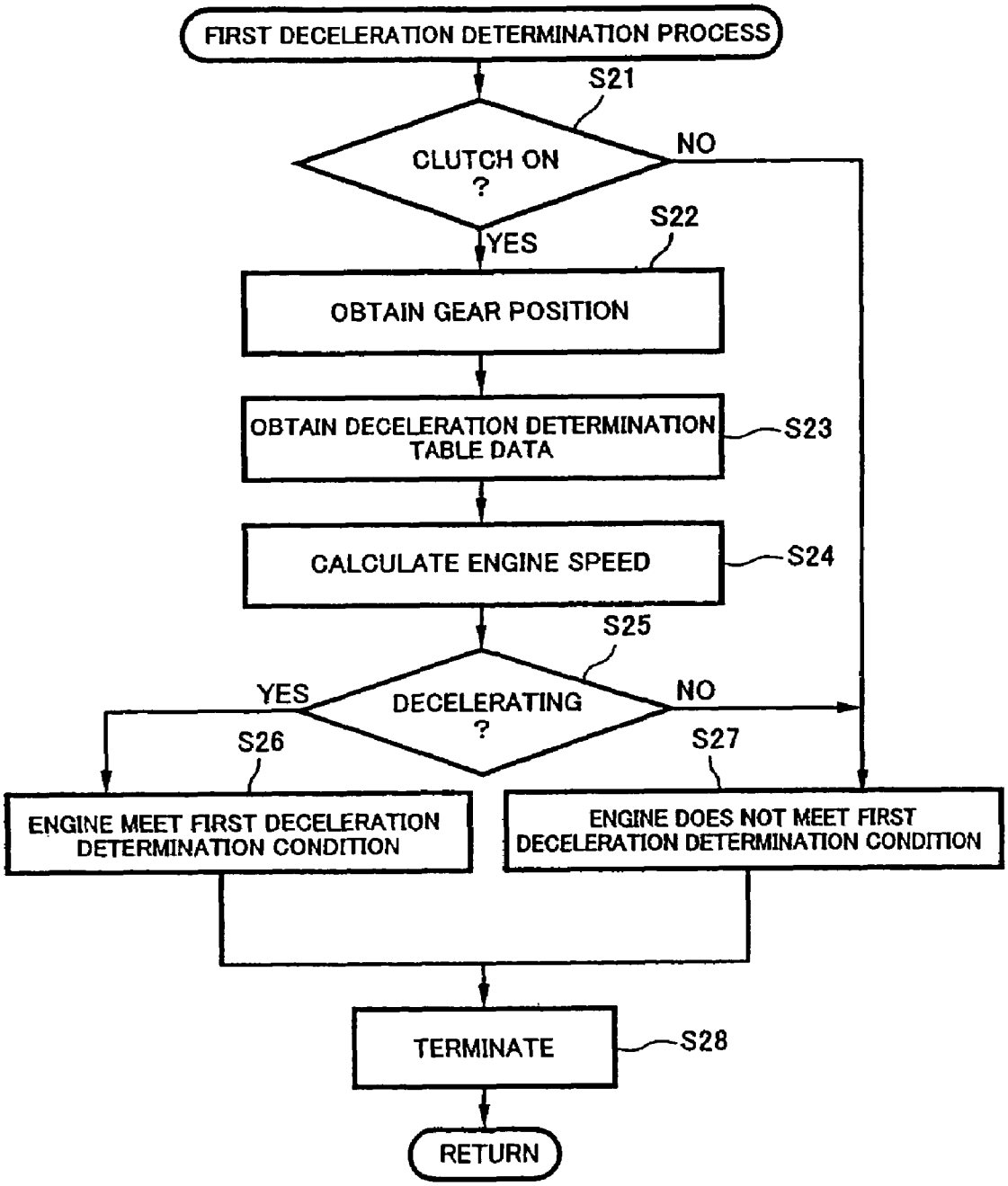
FIG. 6 is a flowchart showing an operation of the fuel feed amount control system of FIG. 4 and illustrating in detail one process in the flowchart of FIG. 5.

FIGS. 5 and 6 are flowcharts showing the operation of the fuel feed amount control system 60. Below, the fuel amount reduction control executed by the fuel feed amount control system 60 during deceleration of the engine E will be described. As shown in FIG. 5, the fuel feed amount control system 60 determines whether or not the engine E is running based on an operated state of an ignition key (not shown) (S1). If it is determined that the engine E is running (S1: YES), the fuel feed amount control system 60 executes the temporal (first) deceleration determination process to determine whether or not the engine E is decelerating (S2).

As illustrated by a sub-routine of the deceleration determination process of FIG. 6, the first deceleration determiner 64 (FIG. 4) of the ECU 57 checks that the clutch 28 is in an on-state, based on the signal received from the clutch sensor 51 (S21). Then, the first deceleration determiner 64 obtains a gear position at the present moment based on the signal received from the gear position sensor 52 (S22) and obtains deceleration determination table data corresponding to the obtained gear position (S23). The deceleration determination table data is data pre-stored in a memory (not shown) in the ECU 57, and is referred to to execute the first deceleration determination process to determine whether or not the engine E is decelerating, i.e., the engine E meets a first deceleration determination condition, based on the engine speed of the engine E, and the air-intake pressure or the throttle opening degree as described later.

Following the step S23, the engine speed calculator 63 of the ECU 57 calculates the engine speed of the engine E based on the signal(s) from the crank angle sensor 50 and/or the cam phase sensor 53 (S24). With reference to the deceleration determination table data obtained in step S23, the first deceleration determiner 64 executes the first deceleration determination process to determine whether or not the engine E is decelerating, i.e., the engine E meets the first deceleration determination condition, based on the engine speed of the engine E calculated in step S24 and the signal received from the air-intake pressure sensor 54 or the throttle opening degree sensor 55 (S25).

Figure 7:
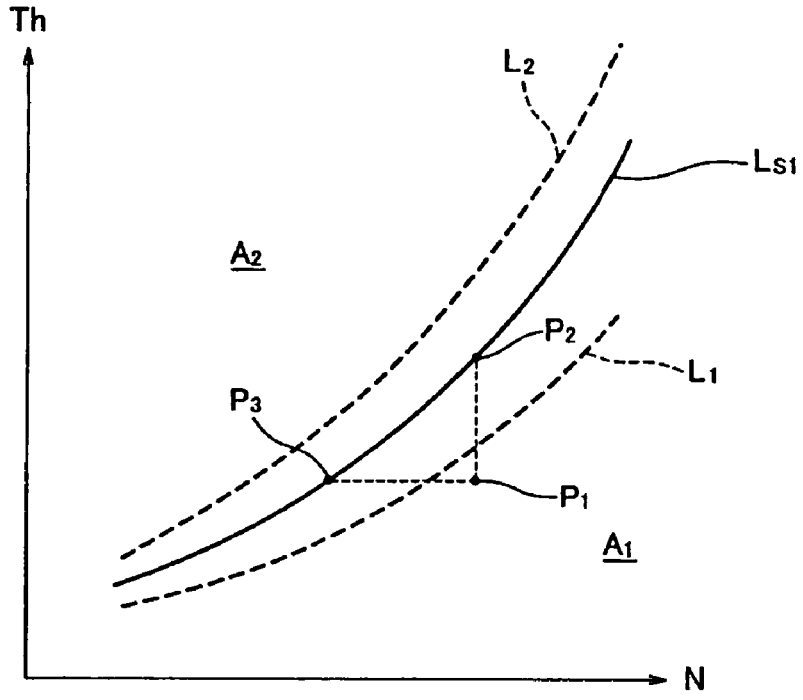
FIG. 7 is a graph showing a principle of a temporary deceleration determination process based on deceleration determination table data, and illustrating the relationship between an engine speed and a throttle opening degree.

FIG. 7 is a graph showing a principle of the first deceleration determination process based on the deceleration determination table data. In the graph of FIG. 7, a horizontal axis indicates the engine speed (N) of the engine E and a vertical axis indicates the throttle opening degree (Th). As shown, a reference curve LS1 indicates a relationship between the throttle opening degree and the engine speed under a steady state, corresponding to a predetermined gear position, and rises to the right.

A region below the reference curve LS1 is a deceleration region A1 indicating a deceleration state of the engine E. To be specific, when the value of the engine speed and the value of the throttle opening degree which have been obtained by the first deceleration determiner 64 are present on coordinates P1 below the reference curve LS1, the obtained throttle opening degree is smaller than a value (coordinates P2) that enables the obtained engine speed to be maintained in a steady state. The engine speed transitions to a lower value (coordinates P3) on the reference curve LS1 that is capable of being maintained in the steady state at such a throttle opening degree, and therefore it is recognized that the engine E is decelerating. On the other hand, a region above the reference curve LS1 is an acceleration region A2 indicating an acceleration state of the engine E. The engine E is decelerating when the value of the engine speed and the value of the throttle opening degree are present on coordinates within the deceleration region A1, whereas the engine E is accelerating when the value of the engine speed and the value of the throttle opening degree are present on coordinates within the acceleration region A2.

Actually, the throttle opening degree calculated based on the signal received from the throttle opening degree sensor 55 contains some error. To eliminate influence of the error, the first deceleration determiner 64 determines whether or not the engine E is decelerating based on a deceleration threshold curve $L_1$ and an acceleration threshold curve $L_2$ created along the reference curve $L_{S1}$ within the deceleration region $A_1$ and the acceleration region A2, respectively, instead of the reference curve $L_{S1}$. To be specific, when the value of the throttle opening degree corresponding to the value of the engine speed is below the deceleration threshold curve $L_1$ within the deceleration region $A_1$, the first deceleration determiner 64 determines that the engine E is decelerating, i.e., the engine E meets the first deceleration determination condition (S25: YES), whereas when the value of the throttle opening degree corresponding to the value of the engine speed is above the acceleration threshold curve $L_2$ within the acceleration region $A_2$, the first deceleration determiner 64 determines that the engine E is accelerating, i.e., the engine E does not meet the first deceleration determination condition (S25: NO). The reference curve $L_{s1}$, the deceleration threshold curve $L_1$ and the acceleration threshold curve $L_2$ are suitably set according to the gear position obtained in step S22 of FIG. 6.

Figure 8:
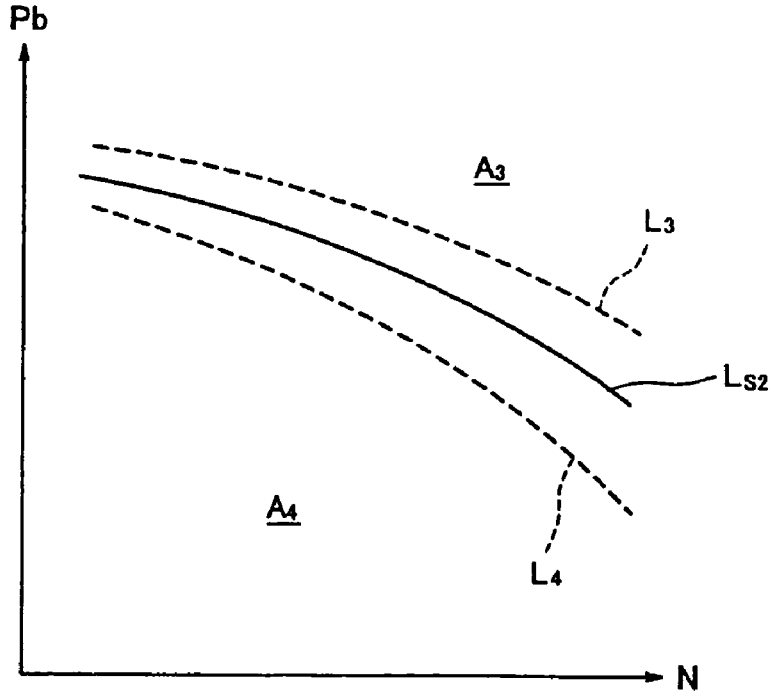
FIG. 8 is a graph showing a principle of the temporary deceleration determination process based on the deceleration determination table data and illustrating the relationship between the engine speed and an air-intake pressure.

FIG. 8 is a graph showing a principle of the first deceleration determination process based on the air-intake pressure obtained based on the signal received from the air-intake pressure sensor 54, and the engine speed. In FIG. 8, a horizontal axis indicates the engine speed (N) of the engine E and a vertical axis indicates the air-intake pressure (Pb). As shown, a reference curve $L_{S2}$ indicates a relationship between the air-intake pressure and the engine speed under the steady state, corresponding to the predetermined gear position, and falls to the right.

In the graph of FIG. 8, a region above a reference curve $L_{S2}$ is a deceleration region $A_3$, and a region below the reference curve $L_{S2}$ is an acceleration region $A_4$. To eliminate influence of some error contained in the value of the air-intake pressure, a deceleration threshold curve $L_3$ and an acceleration threshold curve $L_4$ are created along the reference curve $L_{S2}$ within the deceleration region $A_3$ and the acceleration region $A_4$, respectively. As in the graph of FIG. 8, when the value of the air-intake pressure corresponding to the value of the engine speed is above the deceleration threshold curve $L_3$ within the deceleration region $A_3$, the first deceleration determiner 64 determines that the engine E is decelerating, i.e., the engine E meets the first deceleration determination condition (S25: YES), whereas when the value of the air-intake pressure corresponding to the value of the engine speed is below the acceleration threshold curve $L_4$ within the acceleration region $A_4$, the first deceleration determiner 64 determines that the engine E is accelerating, i.e., the engine E does not meet the first deceleration determination condition (S25: NO). The reference curve $L_{S2}$, the deceleration threshold curve $L_3$ and the acceleration threshold curve $L_4$ are suitably set according to the gear position obtained in step S22 of FIG. 6.

In step S25, the first deceleration determiner 64 may determine whether or not the engine E is decelerating based on the relationship between the engine speed and the throttle opening degree, or based on the relationship between the engine speed and the air-intake pressure. For the purpose of higher precision, the first deceleration determiner 64 may determine whether or not the engine E is decelerating, based on both of these relationships.

If it is determined that the engine E is decelerating in step S25 of FIG. 6 (S25: YES), the first deceleration determiner 64 outputs a signal indicating that the engine E meets the first deceleration determination condition (S26), and terminates the first deceleration determination process in step S2 illustrated in the flowchart of FIG. 5 (S28). On the other hand, if it is determined that the clutch 28 is in an off-state (S21: NO), and if it is determined that the engine E is accelerating in step S25 (S25: NO), the first deceleration determiner 64 outputs a signal indicating that the engine E does not meet the first deceleration determination condition (S27), and terminates the first deceleration determination process in step S2 (see FIG. 5) (S28).

If it is determined that the first deceleration determination process in step S2 of FIG. 5 is terminated in the manner as described above and the determination result is "the engine E meets first deceleration condition" (S3: YES), then the second deceleration determiner 66 executes the final (second) deceleration determination process (S4). In the second deceleration determination process, the second deceleration determiner 66 determines whether the engine speed change rate of the engine E is a positive value or a negative value to determine whether or not the engine E meets the second deceleration determination condition. If it is determined that the engine E meets the second deceleration condition (S5: YES), then the second deceleration determiner 66 determines that the condition for executing the fuel amount reduction control is met (S6), and causes the circuit controller 67 to generate the control signal given to the fuel injection system drive circuit 61 to control the operation of the injector 45, and thus execute fuel amount reduction control (S7). It should be appreciated that a threshold of the engine speed change rate may be suitably set on a negative side and/or a positive side near zero, and may be used as a reference for determining whether or not the engine E meets the second deceleration determination condition.

The amount of fuel may be reduced suitably by reducing the amount of fuel injected from the injector 45, by enlarging intervals at which fuel is injected from the injector 45, or otherwise by combining both of them. In either case, an average fuel injection amount is reduced by a predetermined amount with respect to the reference amount during a time period in which the fuel amount reduction control is executed. The reference amount may be a fuel feed amount corresponding to a constant speed running according to the engine speed, the throttle opening degree, and the air-intake pressure.

After executing the fuel amount reduction control in step S7, step S2 and the following steps are repeated in a predetermined period, and the fuel amount reduction control is continued during a period in which the engine E meets the first deceleration determination condition and the second deceleration determination condition. On the other hand, if it is determined that the engine E is in a stopped state (S1: NO), if the result of the first deceleration determination process in step S2 is that the engine E does not meet the first deceleration determination condition (S3: NO), and if the result of the second deceleration determination process in step S4 is that the engine E does not meet the second deceleration determination condition in step S5 (S5: NO), the fuel amount reduction control is not executed, and step S1 and the following steps are repeated.

Figure 9:
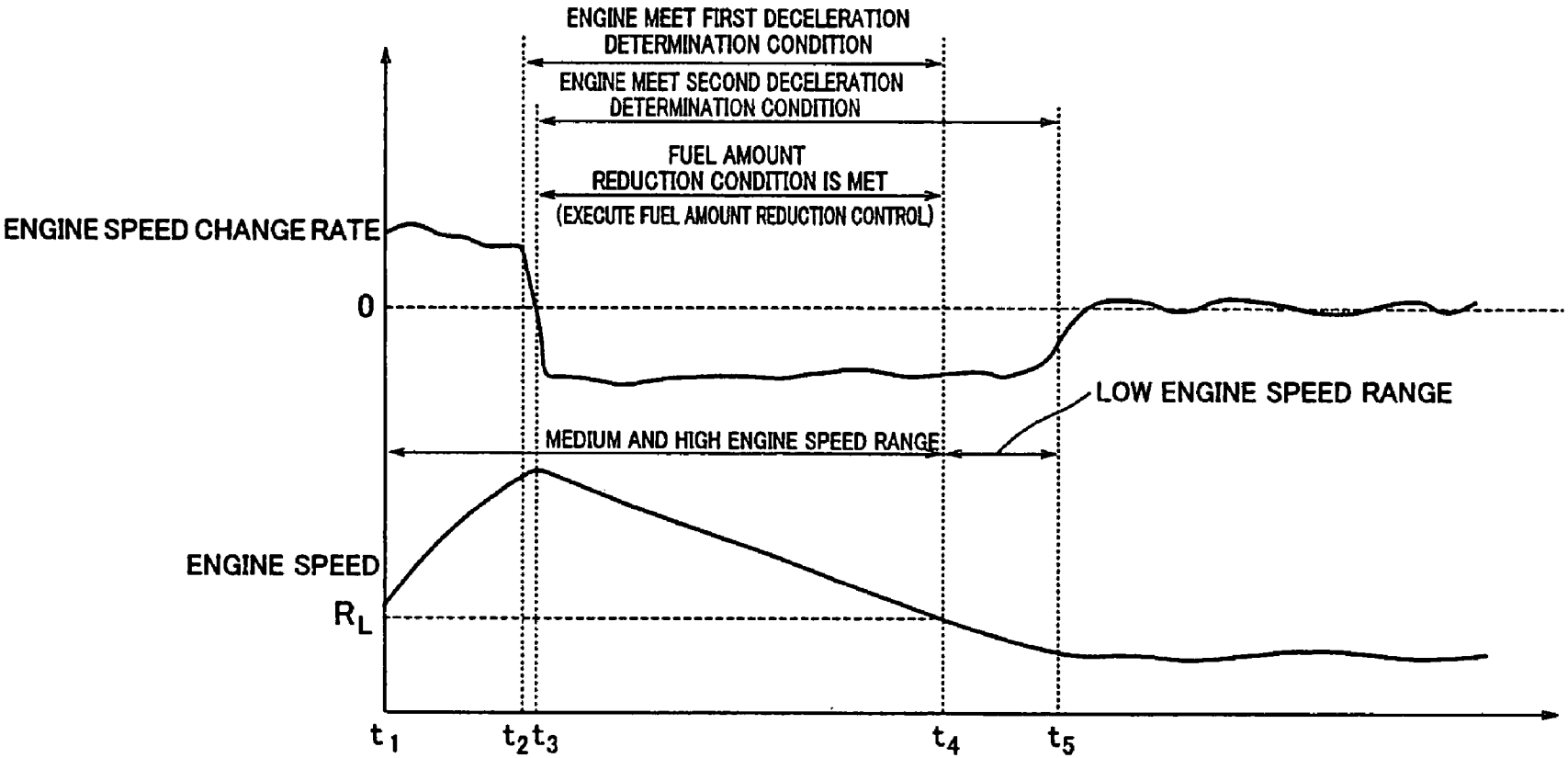
FIG. 9 is a timing chart of a control timing of the fuel feed amount, showing an example of time-lapse changes of the engine speed and an engine speed change rate.

FIG. 9 is a timing chart showing controlled timings of the fuel feed amount, and illustrates an example of time-lapse change of the engine speed and the engine speed change rate. With reference to FIG. 9, times at which the engine E meets or does not meet the first deceleration determination condition and the second deceleration determination condition will be described. In the example of FIG. 9, the engine E is accelerating from time $t_1$ to $t_2$. At time $t_2$, the rider performs a quick throttle operation to fully close the throttle device 20, causing the engine E to start deceleration. From time $t_3$ to time $t_4$, the engine E is decelerating at a substantially constant rate. At time $t_4$, the engine E moves into a low engine speed rage of $R_L$ or less. At time $t_5$, the throttle device 20 is slightly opened and thereby the engine E maintains a constant low engine speed.

Upon the rider's quick throttle operation (time $t_2$), the value of the throttle opening degree and the value of the engine speed fall within the deceleration region $A_1$ illustrated in FIG. 7, and therefore, the engine E meets the first deceleration determination condition (see step S3 of FIG. 5). Then, at time $t_3$, the engine speed change rate falls to below zero and becomes a negative value, the engine E is decelerating, and therefore, the engine E meets the second deceleration condition (see step S5 of FIG. 5). As a result, the fuel amount reduction condition is met (see step S6 of FIG. 5). Thereafter, when the engine E moves into the low engine speed range in which the engine E is running while decelerating to less than the predetermined engine speed $R_L$ (time $t_4$), the engine E does not meet the first deceleration determination condition because of, for example, degraded detecting precision of the throttle opening degree sensor 55, and thus the fuel amount reduction condition is not met. Further, when the rider slightly opens the throttle device 20 to cause the engine E to transition to a constant low engine speed range (time $t_5$), the engine speed change rate of the engine E changes substantially near zero, and thus the engine E does not meet the second deceleration determination condition.

As described above, at the times mentioned above, the first deceleration condition, the second deceleration condition, and the fuel amount reduction condition are met or are not met. The fuel amount reduction control step (see step S7 of FIG. 5) is executed during a time period from time $t_3$ to time $t_4$ of FIG. 9 in which the engine E meets both of the first deceleration determination condition and the second deceleration determination condition. In accordance with the fuel feed method by the fuel feed amount control system 60, the deceleration state of the engine E is able to be determined correctly, and thus the fuel amount reduction can be suitably carried out during deceleration of the engine E.

Whereas the fuel amount reduction control is executed only when the engine E meets both of the first and second deceleration determination conditions based on the gear position, the engine speed of the engine E, the throttle opening degree, the air-intake pressure, and the engine speed change rate of the engine, the configuration of the present invention is not limited to this. For example, the fuel amount reduction control may be executed only when the engine E meets the second deceleration determination condition.

Figure 10:
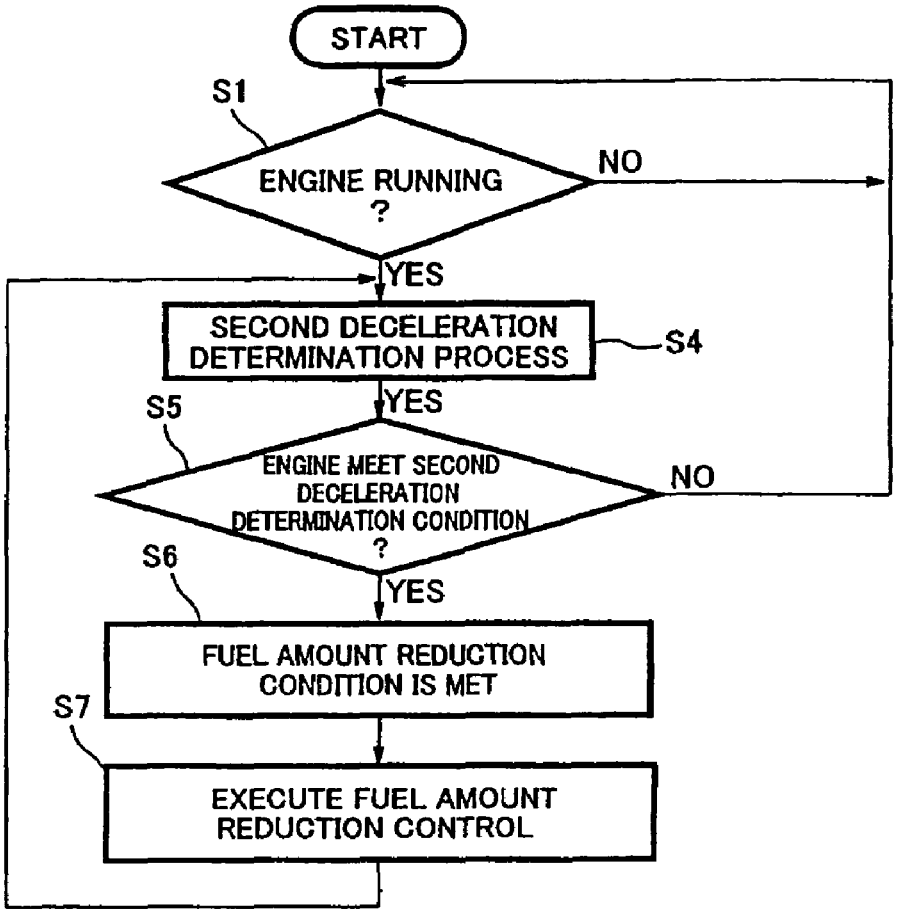
FIG. 10 is a flowchart showing another operation of the fuel feed amount control system of FIG. 4.

To be specific, during the time period $t_3$ to $t_5$ of the timing chart of FIG. 9, the engine speed change rate of the engine E has a negative value, i.e., the engine E meets the second deceleration determination condition. During this time period, the engine speed is decreasing and thus it is determined that the engine E is decelerating. By executing the fuel amount reduction control when the engine E meets the second deceleration determination condition, correct fuel amount reduction can be carried out during deceleration of the engine E. In this case, the clutch sensor 51, the gear position sensor 52, the cam phase sensor 53, the throttle opening degree sensor 55, and the first deceleration determiner 64 may be omitted from the block configuration of the fuel feed amount control system 60 of FIG. 4. The flow of the operation of the fuel feed amount control system 60 is illustrated by the flowchart of FIG. 10, and step S1 and steps S4 to S7 are identical to step S1 and steps S4 to S7 of FIG. 5.

In an alternative control method, in medium and high engine speed ranges (time $t_1$ to $t_4$ of FIG. 9) in which the engine speed of the engine E is larger than the engine speed $R_L$, the fuel amount reduction control may be executed when the engine E meets both of the first and second deceleration determination conditions, whereas in the low engine speed range (time $t_4$ to $t_5$ of FIG. 9) in which the engine speed is $R_L$ or less, the fuel amount reduction control may be executed when the engine E meets the second deceleration determination condition. With this configuration, the fuel amount reduction control can be achieved based on a precise deceleration determination result in the high and medium engine speed ranges. In addition, the fuel amount reduction control can be suitably executed in the low engine speed range. As a result, the fuel amount reduction control can be suitably carried out with improved deceleration determination precision and in a wide engine speed range from high to low. In this case, the fuel feed amount control system 60 checks whether or not the engine E is running as in step S1 of FIG. 5 and then determines whether or not the engine speed of the engine E is larger than the predetermined engine speed $R_L$. If it is determined that the engine speed is larger than the predetermined engine speed $R_L$, then the fuel amount reduction control may be executed according to the flowcharts of FIGS. 5 and 6, whereas if it is determined that the engine speed is not larger than the predetermined engine speed $R_L$, the fuel amount reduction control may be executed according to the flowchart of FIG. 10.

Whereas the step of determining whether or not the clutch 28 is in the on-state (S21) is included in the first deceleration determination process as shown in FIG. 6 in this embodiment, it may be omitted. In addition, the step of obtaining the gear position (S22) may be omitted.

By suitably executing fuel amount reduction control with the above mentioned configuration, cleaning of an exhaust gas is promoted. As a result, life of a catalyst (not shown) provided in the exhaust pipe 18 (see FIG. 1) can be increased.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. A fuel feed amount control system of an engine, comprising:

an engine speed sensor configured to detect an engine speed of the engine;

a fuel feeder configured to feed fuel to air taken into the engine from outside;

at least one of a throttle opening degree sensor configured to detect an opening degree of a throttle valve and an air-intake pressure sensor configured to detect a pressure of the air taken into the engine;

a controller configured to cause the fuel feeder to feed a predetermined amount of fuel to air, based on a signal received from the engine speed sensor;

wherein the controller is configured to obtain a time-lapse change rate of the engine speed based on the signal received from the engine speed sensor, determine that the engine is decelerating based on the time-lapse change rate, and cause the fuel feeder to reduce a fuel feed amount to less than a reference amount preset according to the engine speed responsive to determining that the engine is decelerating; and wherein the controller is configured to determine that the engine is decelerating, based on the time-lapse change rate of the engine speed, the engine speed, and at least one of the throttle opening degree obtained from a signal received from the throttle opening degree sensor and the air-intake pressure obtained from a signal received from the air-intake pressure sensor.

2. The fuel feed amount control system according to claim 1, wherein the controller is configured to cause the fuel feeder to reduce a fuel feed amount of the fuel fed to the engine during engine deceleration to less than a reference amount preset according to the engine speed responsive to determining that the engine is decelerating.

3. The fuel feed amount control system according to claim 2, further comprising:

a gear position sensor configured to detect a gear position of a transmission system of the engine;

wherein the controller is configured to determine that the engine is decelerating, based on the time-lapse change rate of the engine speed, the engine speed, at least one of the throttle opening degree and the air-intake pressure, and the gear position obtained from a signal received from the gear position sensor.

4. The fuel feed amount control system according to claim 3, further comprising:

a clutch sensor configured to detect an on-state of a clutch;

wherein the controller is configured to determine that the engine is decelerating, based on the time-lapse change rate of the engine speed, the engine speed, at least one of the throttle opening degree and the air-intake pressure, the gear position, and the on-state of the clutch obtained from a signal received from the clutch sensor.

5. A motorcycle comprising:

a fuel feed amount control system of an engine including:

an engine speed sensor configured to detect an engine speed of an engine;

a fuel feeder configured to feed fuel to air taken into the engine from outside;

at least one of a throttle opening degree sensor configured to detect an opening degree of a throttle valve and an air-intake pressure sensor configured to detect a pressure of the air taken into the engine;

a controller configured to cause the fuel feeder to feed a predetermined amount of fuel to air, based on a signal received from the engine speed sensor;

wherein the controller is configured to obtain a time-lapse change rate of the engine speed based on the signal received from the engine speed sensor, determine that the engine is decelerating based on the time-lapse change rate, and cause the fuel feeder to reduce a fuel feed amount to less than a reference amount preset according to the engine speed responsive determining that the engine is decelerating; and wherein the controller is configured to determine that the engine is decelerating, based on the time-lapse change rate of the engine speed, the engine speed, and at least one of the throttle opening degree obtained from a signal received from the throttle opening degree sensor and the air-intake pressure obtained from a signal received from the air-intake pressure sensor.

* * * * *